US007616174B2

(12) United States Patent
Lee

(10) Patent No.: US 7,616,174 B2
(45) Date of Patent: Nov. 10, 2009

(54) PLASMA DISPLAY PANEL, AND APPARATUS AND METHOD FOR DRIVING THE SAME

(75) Inventor: Joo-Yul Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 1055 days.

(21) Appl. No.: 10/980,088

(22) Filed: Nov. 2, 2004

(65) Prior Publication Data

US 2005/0099365 A1 May 12, 2005

(30) Foreign Application Priority Data

Nov. 10, 2003 (KR) ..... 10-2003-0079107

(51) Int. Cl.
*G09G 3/28* (2006.01)

(52) U.S. Cl. ..... 345/60; 345/61; 345/62; 345/67; 345/68

(58) Field of Classification Search ..... 345/37, 345/60–69, 98, 204, 211, 212, 691, 41, 99; 315/169.2, 169.4, 169.3, 169.1; 341/144
See application file for complete search history.

(56) References Cited

U.S. PATENT DOCUMENTS 6,630,796 B2 * 10/2003 Tokunaga et al. ..... 315/169.4
6,844,685 B2 * 1/2005 Lee ..... 315/169.3
6,862,009 B2 * 3/2005 Park ..... 345/67
6,876,341 B2 * 4/2005 Ide et al. ..... 345/60
7,126,592 B2 * 10/2006 Willis et al. ..... 345/204
7,196,680 B2 * 3/2007 Park ..... 345/63
7,417,603 B2 * 8/2008 Kim et al. ..... 345/60
7,420,528 B2 * 9/2008 Lee ..... 345/60
7,477,212 B2 * 1/2009 Choi ..... 345/60
2002/0195963 A1 * 12/2002 Tokunaga et al. ..... 315/169.3
2003/0043133 A1 * 3/2003 Tzelnick ..... 345/204
2003/0071768 A1 * 4/2003 Park ..... 345/60
2004/0046752 A1 * 3/2004 Willis et al. ..... 345/204
2004/0085262 A1 * 5/2004 Lee ..... 345/41
2004/0090395 A1 * 5/2004 Park ..... 345/41

(Continued)

FOREIGN PATENT DOCUMENTS

JP 2001-184023 7/2001

(Continued)

OTHER PUBLICATIONS

Patent Abstracts of Japan, Publication No. 2001-184023; Date of Publication: Jul. 6, 2001; in the name of Shunichi Wakabayashi et al.

(Continued)

*Primary Examiner*—Prabodh M Dharia
(74) *Attorney, Agent, or Firm*—Christie, Parker & Hale, LLP

(57) ABSTRACT

An apparatus and method for driving a plasma display panel and includes two ramp switches. The two ramp switches are used to apply a two-step falling ramp waveform to a Y electrode of the plasma display panel in a reset period, thereby lowering a withstand voltage of a switch which is formed on a main path to block the flow of current when the falling ramp waveform is applied.

17 Claims, 11 Drawing Sheets

U.S. PATENT DOCUMENTS

2004/0164929 A1* 8/2004 Ide et al. ..... 345/60

FOREIGN PATENT DOCUMENTS

| | | |
|---|---|---|
| JP | 2001-228821 | 8/2001 |
| JP | 2002-215089 | 7/2002 |
| JP | 2003-15595 | 1/2003 |
| JP | 2003-302932 | 10/2003 |

OTHER PUBLICATIONS

Patent Abstracts of Japan, Publication No. 2001-228821; Date of Publication: Aug. 24, 2001; in the name of Shinji Masuda et al.

Patent Abstracts of Japan, Publication No. 2002-215089; Date of Publication: Jul. 31, 2002; in the name of Shigetoshi Tomio et al.

Patent Abstracts of Japan, Publication No. 2003-015595; Date of Publication: Jan. 17, 2003; in the name of Shigeo Ide et al.

Patent Abstracts of Japan, Publication No. 2003-302932; Date of Publication: Oct. 24, 2003; in the name of Chung-Wook Roh et al.

* cited by examiner

PLASMA DISPLAY PANEL, AND APPARATUS AND METHOD FOR DRIVING THE SAME

CROSS REFERENCE TO RELATED APPLICATION

This application claims priority to and the benefit of Korean Patent Application No. 10-2003-0079107 filed on Nov. 10, 2003, in the Korean Intellectual Property Office, the entire content of which is incorporated herein by reference.

BACKGROUND OF THE INVENTION (a) Field of the Invention

The present invention relates to an apparatus and method for driving a plasma display panel (PDP).

(b) Description of the Related Art

Recently, a PDP is being highlighted as a flat panel display in that it is advantageous over the other flat panel displays in regard to its high luminance, high luminous efficiency and wide viewing angle.

The PDP is a flat panel display that uses plasma generated by gas discharge to display characters or images. According to its size, the PDP can include tens to millions of pixels arranged in the form of a matrix. The structure of the PDP will now be described with reference to FIGS. 1 and 2.

FIG. 1 is a partial perspective view of a conventional PDP, and FIG. 2 shows an arrangement of electrodes in the conventional PDP.

As shown in FIG. 1, the conventional PDP includes two glass substrates 1 and 6 spaced apart from each other to face each other. Scan electrodes 4 and sustain electrodes 5 are formed in pairs in parallel on the glass substrate and are covered with a dielectric layer 2 and a protection film 3. Formed on the glass substrate 6 are a plurality of address electrodes 8, which are covered with an insulation layer 7. Barrier ribs 9 are formed in parallel with the address electrodes 8 on the insulation layer 7 such that each of them is interposed between the adjacent address electrodes 8. Phosphors 10 are coated on the surface of the insulation layer 7 and on both sides of each of the barrier ribs 9. The glass substrates 1 and 6 are arranged to face each other while defining a discharge space 11 therebetween so that the address electrodes 8 are orthogonal to the scan electrodes 4 and sustain electrodes 5. In the discharge space 11, discharge cells 12 are respectively formed at intersections between the address electrodes 8 and the pairs of scan electrodes 4 and sustain electrodes 5.

As shown in FIG. 2, a PDP includes a representative discharge cell 12 as schematically indicated and the electrodes of the PDP are arranged in the form of an n×m matrix. That is, a plurality of address electrodes $A_1$ to $A_m$ are arranged in a column direction, and a plurality of scan electrodes $Y_1$ to $Y_n$ and a plurality of sustain electrodes $X_1$ to $X_n$ are arranged in pairs in a row direction.

In the PDP, generally, one frame is divided into a plurality of sub-fields that are combined to express a gray scale. Each of the sub-fields is generally composed of a reset period, an address period and a sustain period.

In the reset period, wall charges formed by a previous sustain discharge are erased. Also, wall charges are set up to stably perform a next address discharge. In the address period, cells that are turned on and cells that are not turned on are selected in the panel, and wall charges are accumulated on the turned-on cells (i.e., addressed cells). In the sustain period, a sustain discharge occurs to actually display an image on the addressed cells.

Here, the term "wall charges" refers to charges that are formed proximate to the electrodes on the wall (for example, dielectric layer) of the discharge cells and stored on the electrodes. The wall charges do not actually touch the electrodes themselves because the dielectric layer covers the electrodes. However, for simplicity of description, the charges will be described herein as being "formed on", "stored on" and/or "accumulated on" the electrodes. Further, the term "wall voltage" refers to a potential difference that is generated on the wall of the discharge cells by the wall charges.

In order to improve efficiency of the PDP, it has recently been proposed to raise the ratio of xenon (Xe) in discharge gas to more than 10%. The higher the ratio of Xe becomes, the higher a discharge firing voltage becomes. As a result and shown in the driving waveforms of FIG. 3, a voltage to a Y electrode is lowered to a negative voltage VscL in a Y ramp falling period (that begins in the reset period), and a scan pulse to the Y electrode is also lowered to the negative voltage VscL in the address period.

FIG. 4 is a circuit diagram of a driving circuit that applies the driving waveforms of FIG. 3 to X and Y electrodes.

As shown in FIG. 4, the driving circuit that applies the driving waveforms as shown in FIG. 3 includes a switch Ypp formed on a main path for causing a rising reset voltage to have no effect on a sustain discharge circuit, and a switch Ypn formed on the main path for causing a falling reset voltage to have no effect on other circuits when it is reduced to a voltage VscL lower than a base level of a sustain discharge voltage.

When a voltage Vs is applied to the Y electrode before a falling reset pulse is applied in FIG. 3, the drain voltage of the switch Ypn becomes the same voltage Vs as that of the Y electrode. Thereafter, if the falling reset pulse is applied to the Y electrode as a switch Yfr is turned on under the condition that the switch Ypn is turned off, the source voltage of the switch Ypn falls to the voltage VscL under the condition that the drain voltage thereof is the voltage Vs.

As a result, a high voltage (Vs-VscL) is applied between the drain and source of the switch Ypn. In order to withstand this high voltage, it is necessary to use a switch with a high withstand voltage as the switch Ypn, resulting in an increase in manufacturing cost.

SUMMARY OF THE INVENTION

Therefore, it is an aspect of the present invention to provide an apparatus for driving a plasma display panel, wherein two switches are used to apply a falling reset pulse, so that a withstand voltage of a switch formed on a main path can be lowered.

In an exemplary embodiment according to the present invention, there is provided an apparatus for driving a plasma display panel having first and second electrodes formed therein to apply a slowly falling waveform to the first electrode. The apparatus includes a sustain driver, a first transistor, a second transistor, and a third transistor. The sustain driver applies a sustain discharge voltage to the first electrode. The first transistor has a first main terminal coupled to the sustain driver and a second main terminal coupled to the first electrode. The second transistor has a first main terminal coupled to the first electrode and a second main terminal coupled to a first voltage source that supplies a first voltage level. The third transistor has a first main terminal coupled between the sustain driver and the first main terminal of the first transistor and a second main terminal coupled to a second voltage source that supplies a second voltage level. The second and third transistors allow a voltage at the first electrode to fall slowly from a third voltage level to the second voltage level and then slowly from the second voltage level to the first voltage level.

The apparatus may further include a fourth transistor having a first main terminal coupled to the first main terminal of the first transistor and a second main terminal coupled to the sustain driver.

The first main terminal of the third transistor may be coupled to a connection point of the first transistor and the fourth transistor or a connection point of the fourth transistor and the sustain driver.

A voltage between the first main terminal and second main terminal of the first transistor may be the same in level as the second voltage level when a waveform falling from the second voltage level to the first voltage level is applied to the first electrode.

The first, second, and third transistors may be n-channel transistors, and the first main terminals of the first, second, and third transistors may be drains and the second main terminals of the first, second, and third transistors may be sources.

In another exemplary embodiment according to the present invention, there is provided a method for driving a plasma display panel. The plasma display panel includes a panel capacitor formed between a first electrode and a second electrode and a first transistor having a first main terminal coupled to a sustain driver that applies a sustain voltage to the panel capacitor and a second main terminal coupled to the first electrode. In the method, in a reset period, a) a voltage at the first electrode is reduced from a first voltage level to a second voltage level through a second transistor having a first main terminal coupled between the first transistor and the sustain driver, and b) the voltage at the first electrode is reduced from the second voltage level to a third voltage level through a third transistor having a first main terminal coupled between the first electrode and the first transistor.

At the step b), the first transistor may have a withstand voltage which is the same in level as the third voltage level.

The first, second, and third transistors may be n-channel transistors, and the first main terminals of the first, second, and third transistors may be drains and the second main terminals of the first, second, and third transistors may be sources.

In yet another exemplary embodiment according to the present invention, a plasma display panel includes a plasma panel having first and second electrodes formed therein; and a driver for applying a driving waveform to the plasma panel to drive it. In the plasma display panel, the driver includes a first transistor, a second transistor, a third transistor, a fourth transistor, and a fifth transistor. The first transistor is coupled between a first node and a first voltage source that supplies a first voltage level for sustain discharge to the first electrode in a sustain period. The second transistor has a first main terminal coupled to a second node and a second main terminal coupled to the first node. The third transistor has a first main terminal coupled to the second node and a second main terminal coupled to a third node that is coupled to the first electrode. The fourth transistor has a first main terminal coupled to the third node and a second main terminal coupled to a second voltage source that supplies a second voltage level, the fourth transistor being operated to slowly reduce a voltage at the first electrode. The fifth transistor has a first main terminal coupled to the first node and a second main terminal coupled to a third voltage source that supplies a third voltage level lower than the second voltage level, the fifth transistor being operated to slowly reduce the voltage at the first electrode.

The fourth transistor of the driver may be turned on to reduce the voltage at the first electrode to a desired voltage level, and the fifth transistor of the driver may then be turned on to reduce the voltage at the first electrode to the third voltage level.

The third, fourth, and fifth transistors may be n-channel transistors, and the first main terminals of the third, fourth, and fifth transistors may be drains and the second main terminals of the third, fourth, and fifth transistors may be sources.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

Figure 1:
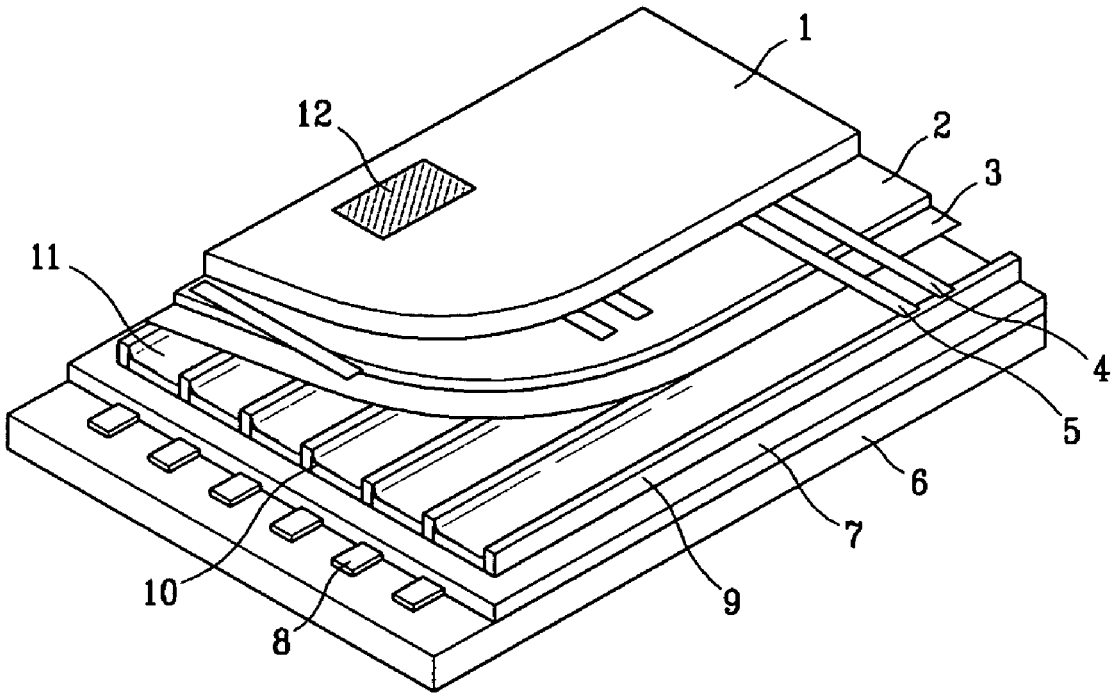
FIG. 1 (Prior Art)
FIG. 1 is a partial perspective view of a conventional PDP.
Figure 2:
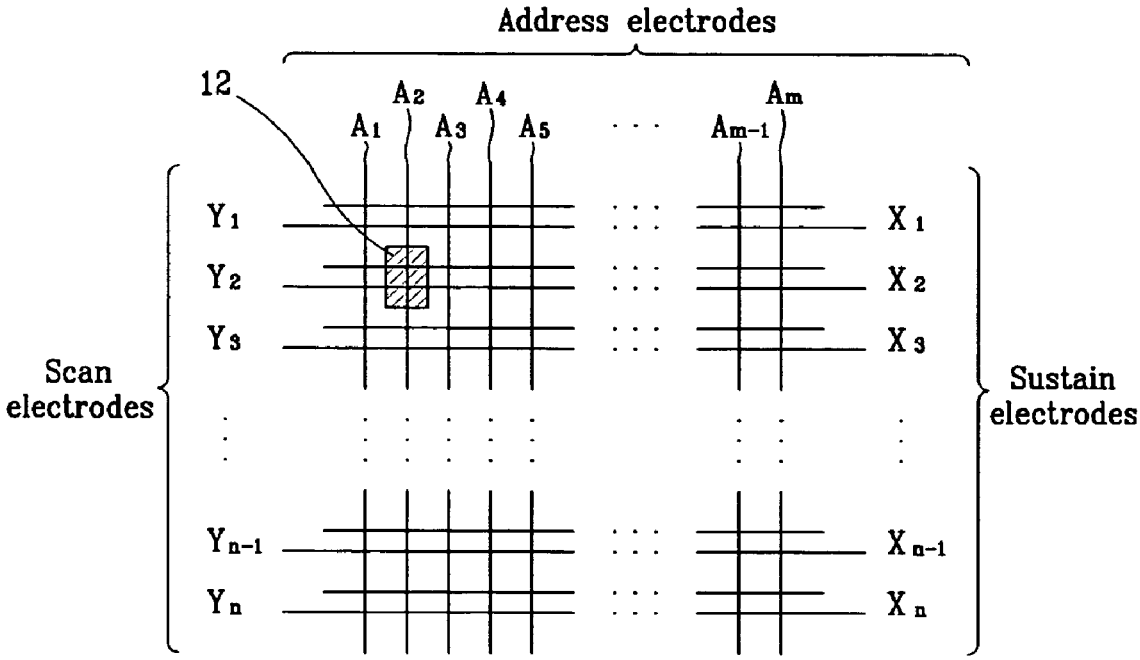
FIG.2(Prior Art)
FIG. 2 shows an arrangement of electrodes in the conventional PDP.
Figure 3:
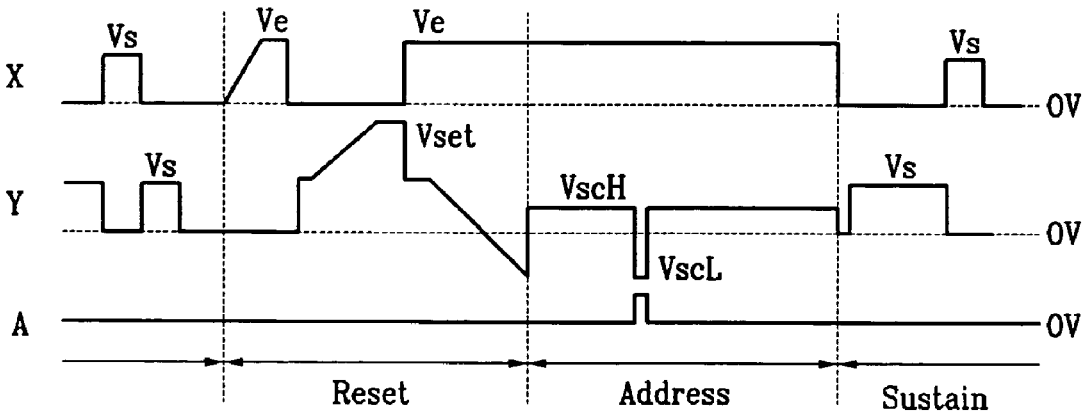
FIG.3(Prior Art)
FIG. 3 is a waveform diagram of driving waveforms of the conventional PDP.
Figure 4:
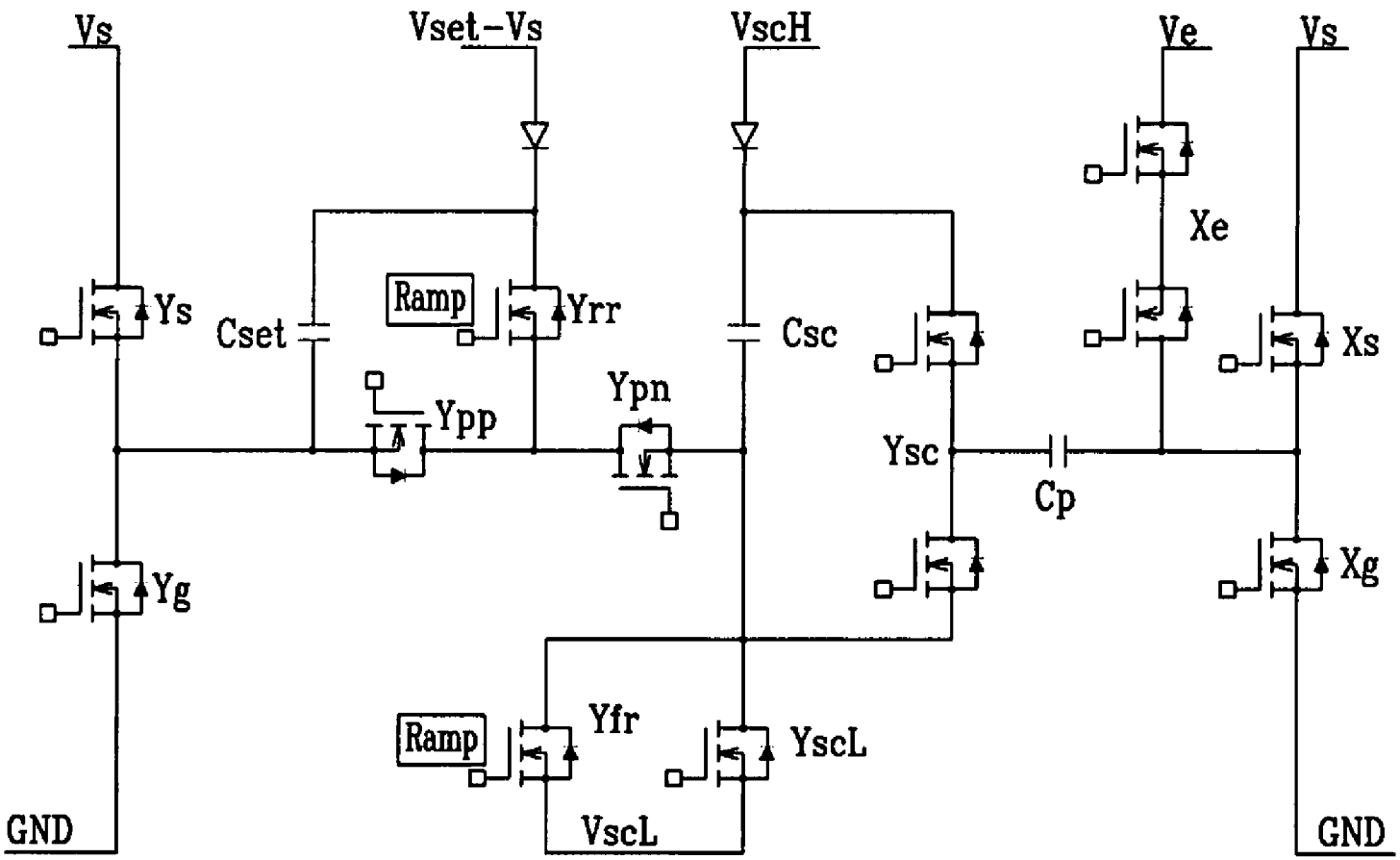
FIG. 4(Prior Art)
FIG. 4 is a circuit diagram of a driving circuit that applies the driving waveforms of FIG. 3.
Figure 5:
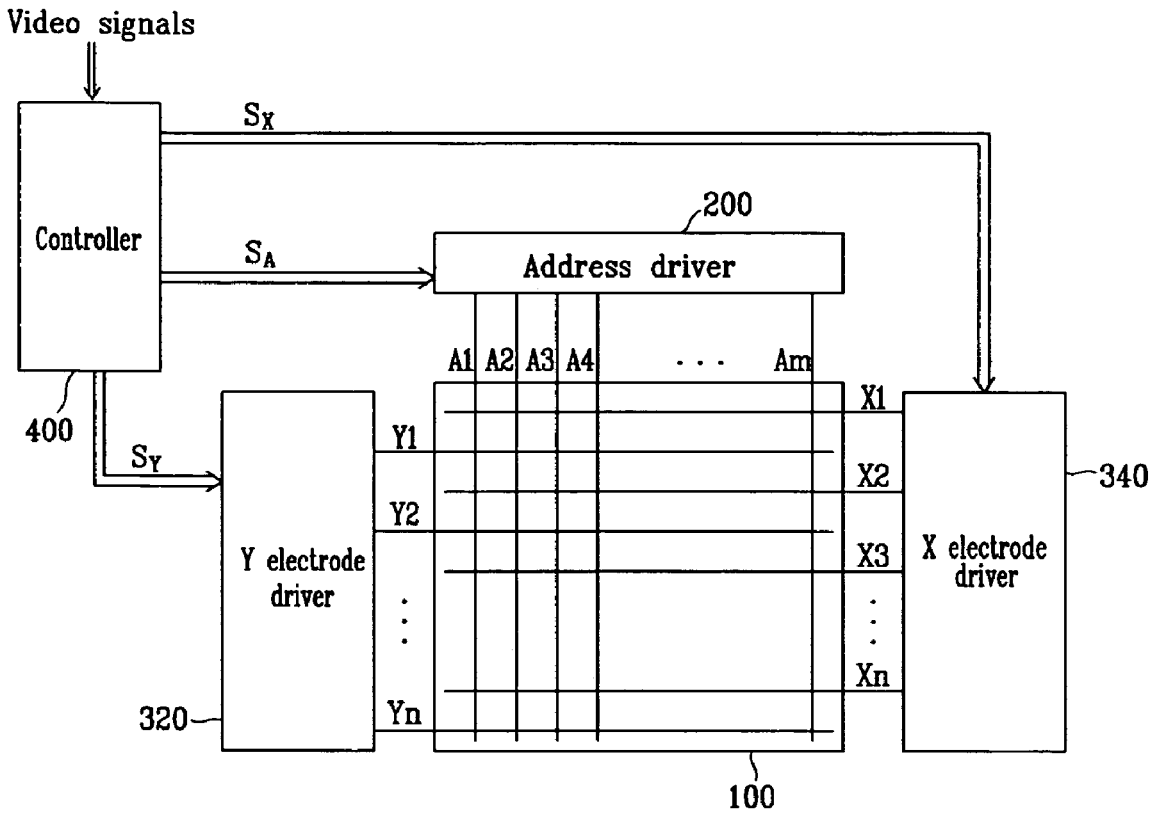
FIG. 5 shows the configuration of a PDP according to an embodiment of the present invention.

As shown in FIG. 5, the PDP according to the embodiment of the present invention includes a plasma panel 100, an address driver 200, a Y electrode driver 320, an X electrode driver 340 and a controller 400.

The plasma panel 100 includes a plurality of address electrodes $A_1$ to $A_m$ arranged in a column direction, and a plurality of first electrodes $Y_1$ to $Y_n$(referred to hereinafter as Y electrodes) and a plurality of second electrodes $X_1$ to $X_n$ (referred to hereinafter as X electrodes) arranged in a row direction.

The address driver 200 receives an address driving control signal $S_A$ from the controller 400, and applies display data signals to the respective address electrodes $A_1$ to $A_m$ to select desired discharge cells to be displayed.

The Y electrode driver 320 and the X electrode driver 340 respectively receive a Y electrode driving signal $S_Y$ and an X electrode driving signal $S_X$ from the control unit 400, and apply driving voltages to the X electrodes and the Y electrodes, respectively, to sustain the selected discharge cells.

The control unit 400 externally receives a video signal, generates the address driving control signal $S_A$, Y electrode driving signal $S_Y$ and X electrode driving signal $S_X$, and transfers the generated signals respectively to the address driver 200, Y electrode driver 320 and X electrode driver 340.

Figure 6:
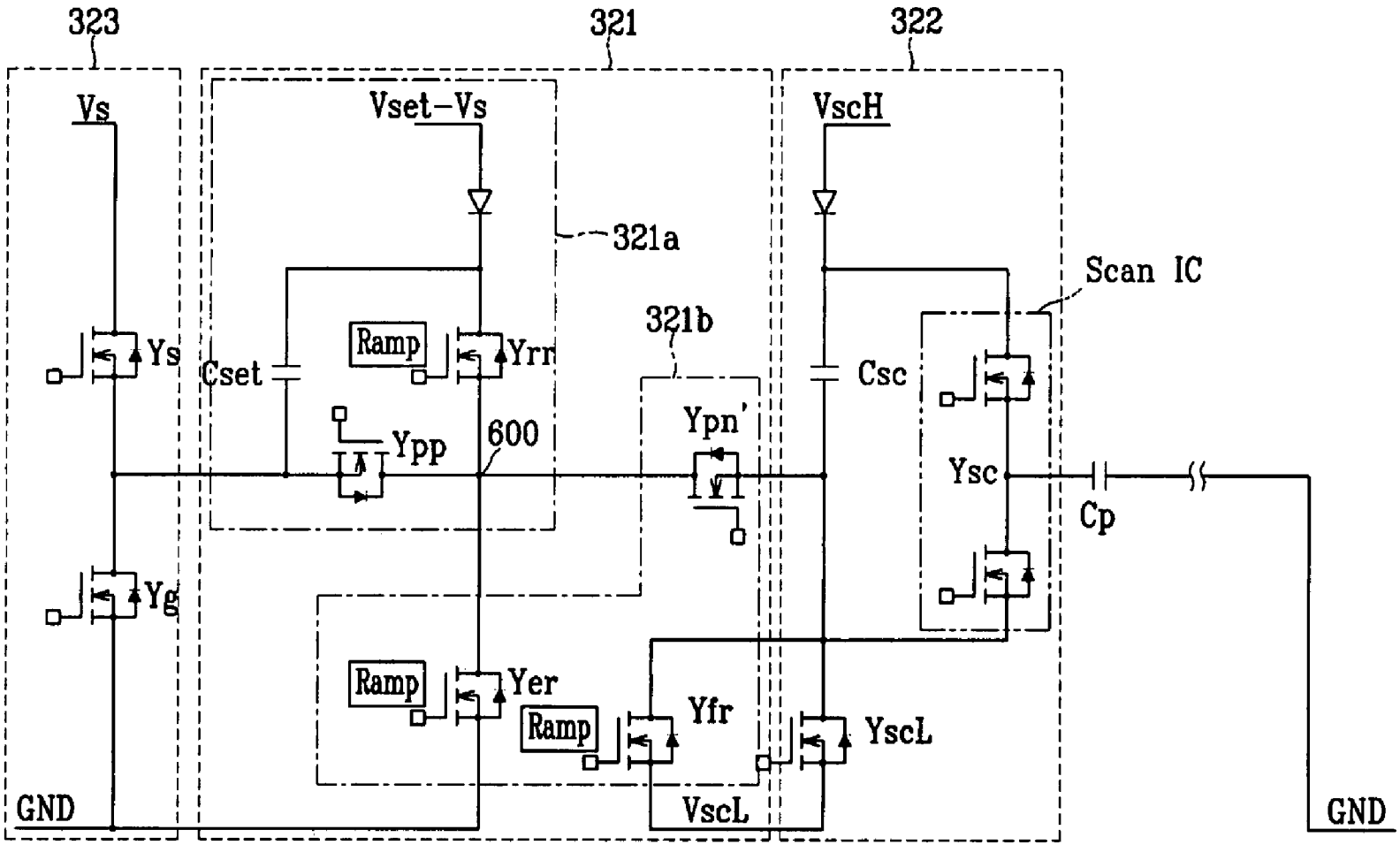
FIG. 6 is a detailed circuit diagram of a Y electrode driver of a PDP according to a first embodiment of the present invention.

FIG. 6 is a detailed circuit diagram of a Y electrode driver (e.g., the driver 320 of FIG. 5) of a PDP (e.g., the PDP of FIG. 5) according to a first embodiment of the present invention.

As shown in FIG. 6, the Y electrode driver (e.g., the driver 320 of FIG. 5) according to the first embodiment of the present invention includes a reset driver 321, a scan driver 322 and a sustain driver 323.

The reset driver 321 includes a rising ramp generator 321*a* for generating a rising reset waveform in a reset period and a falling ramp generator 321*b* for generating a falling reset waveform in the reset period.

The rising ramp generator 321*a* includes a voltage source Vset-Vs, a capacitor Cset for operating with a floating voltage, a ramp switch Yrr, and a switch Ypp formed on a main path for preventing a reverse flow of current. The falling ramp generator 321*b* includes a ramp switch Yfr connected to a voltage source VscL, and a switch Ypn' formed on the main path for preventing a reverse flow of current. The falling ramp generator 321*b* further includes a ramp switch Yer connected between a connection point 600 (of the switch Ypp and switch Ypn') and a ground terminal GND.

The scan driver 322 generates a scan pulse in an address period, and includes (and/or is coupled to) the voltage source VscL, a voltage source VscH, a capacitor Csc, a switch YscL, and a scan driver IC including a switch Ysc.

The sustain driver 323 generates a sustain discharge pulse in a sustain period, and includes switches Ys and Yg connected between a voltage source Vs and the ground terminal GND.

Here, a panel capacitor Cp is an equivalent expression of a capacitance component between the associated X and Y electrodes. Although the X electrode of the panel capacitor Cp is initially connected to an X electrode driver (e.g., the driver 340 of FIG. 5), it is only shown here to be connected with the ground terminal through a broken line for the convenience of description.

Further, in the present embodiment, the switches Ypn', Yfr and Yer are described and shown to be n-channel MOS transistors for illustrative purposes only. The scope of the present invention, however, is not limited to n-channel and/or MOS transistors. Instead, all or some of the transistors can be replaced by any suitable active elements, each of which has a control terminal, a first main terminal, and a second main terminal, and control the current flowing to the second terminal from the first terminal according to a signal applied to the control terminal (e.g., a voltage applied between the control terminal and the first terminal). Of course, those skilled in the art would recognize that the voltage polarities and levels may be different when other active elements are used.

A process of applying a falling reset pulse to the panel capacitor Cp by the Y electrode driver of FIG. 6 (e.g., the driver 320) according to the first embodiment of the present invention will hereinafter be described with reference to FIGS. 7A and 7B.

Figure 7A:
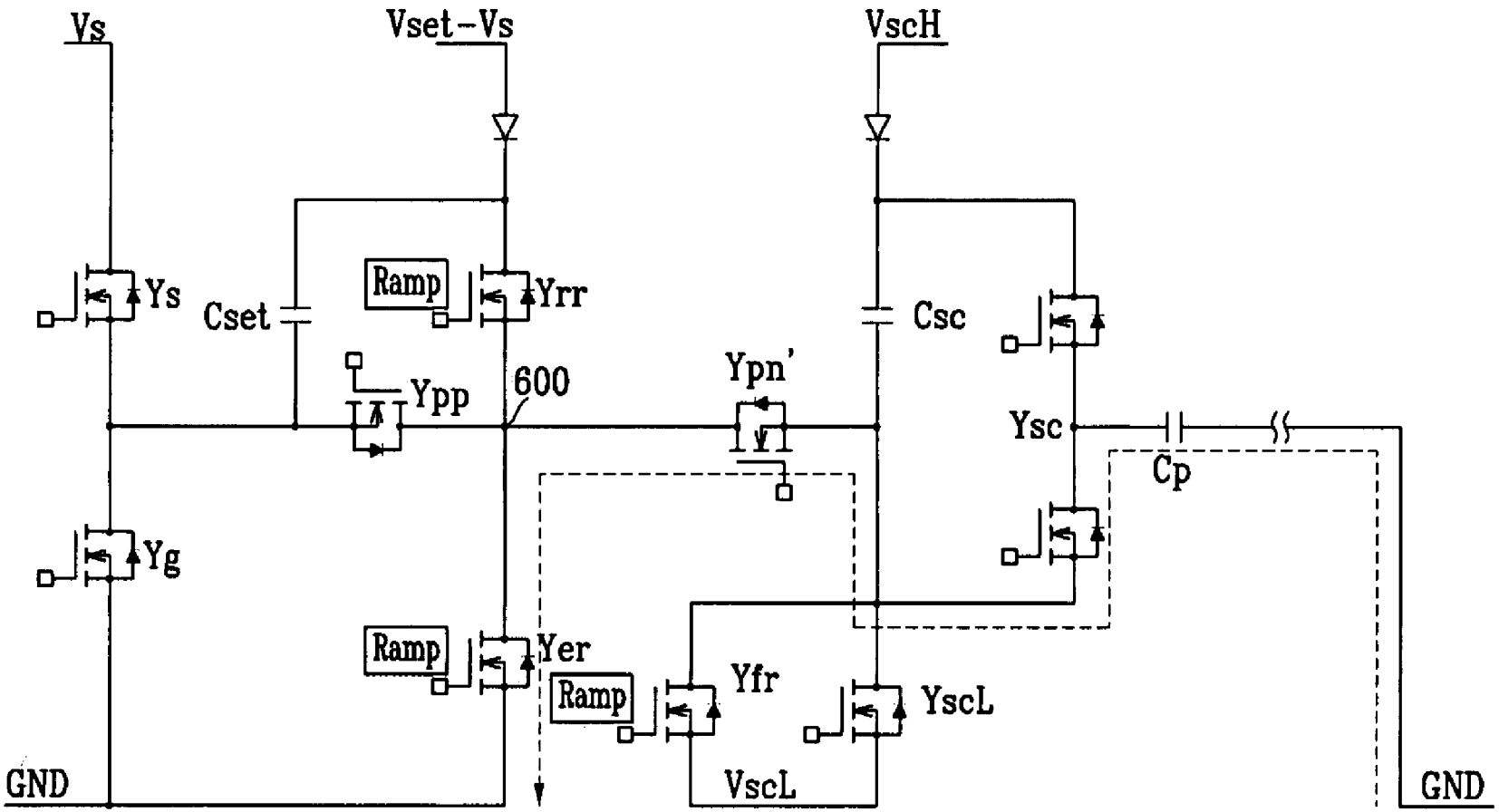
FIGS. 7A and 7B are circuit diagrams illustrating current paths when a falling reset waveform is applied to a Y electrode of a panel capacitor Cp in a reset period by the Y electrode driver according to the first embodiment of the present invention.
Figure 7B:
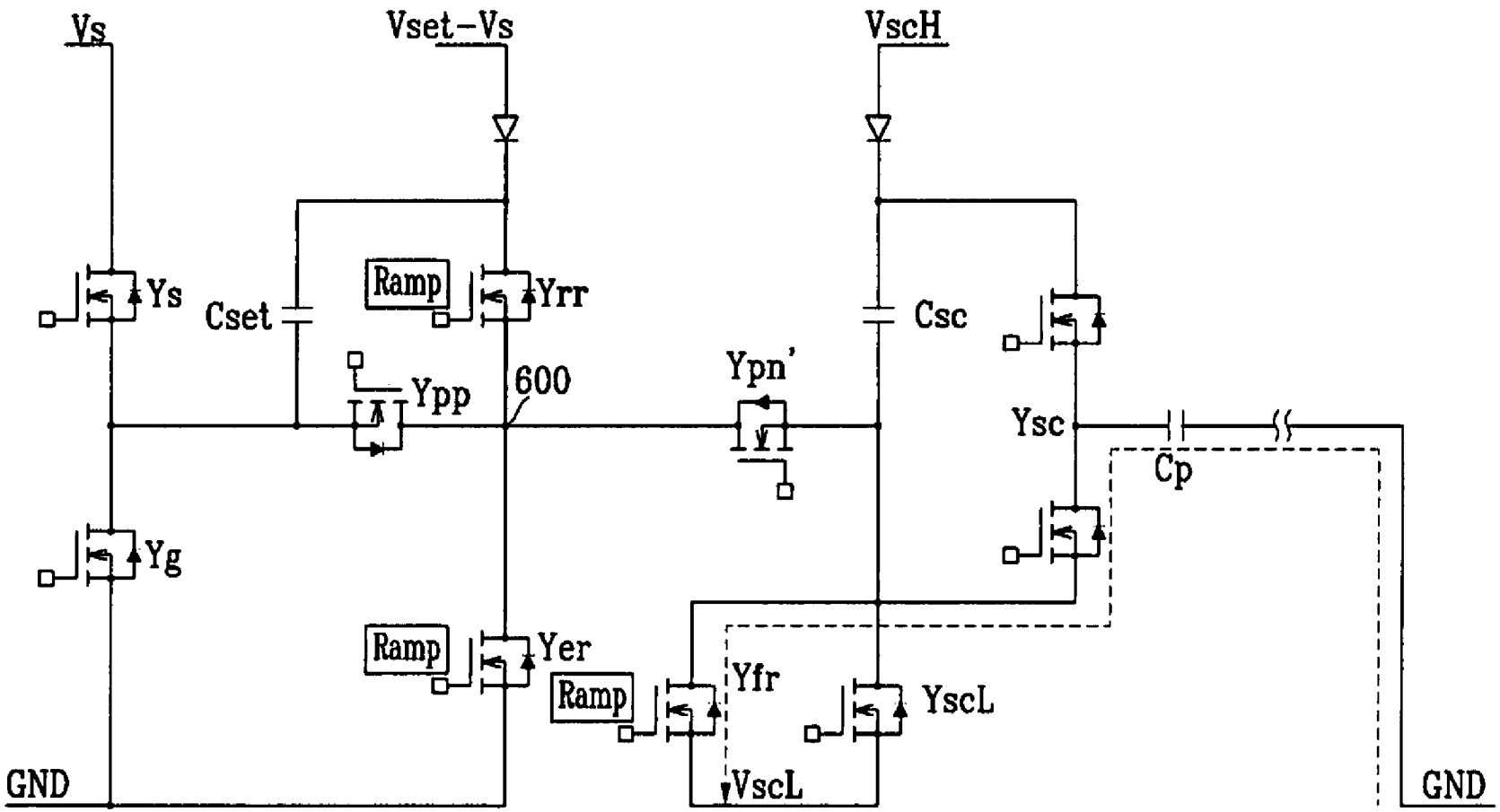

FIGS. 7A and 7B are circuit diagrams illustrating current paths when a falling reset waveform is applied to the Y electrode of the panel capacitor Cp in the reset period by the Y electrode driver of FIG. 6 (e.g., the driver 320) according to the first embodiment of the present invention.

Before a falling reset waveform is applied to the Y electrode, the switches Ys and Ypn' are turned on and the switch Ypp is turned off, so that a voltage Vs is applied to the Y electrode. As a result, each of the source voltage and drain voltage of the switch Ypn becomes the voltage Vs.

Thereafter, when the switch Ypn' is turned off and the switch Yer is turned on, a falling ramp waveform of the first step that is slowly reduced from the voltage Vs to 0V is applied to the panel capacitor Cp along a path (path of FIG. 7A) of panel capacitor Cp—switch Ysc—body diode of switch Ypn'—switch Yer—ground terminal GND. At this time, each of the source voltage and drain voltage of the switch Ypn' becomes 0V, too.

Next, when the switch Yer is turned off and the switch Yfr is turned on under the is condition that the switch Ypn' is in its off state, a falling ramp waveform of the second step that is slowly reduced from 0V to a voltage VscL is applied to the panel capacitor Cp along a path (path of FIG. 7B) of panel capacitor Cp—switch Ysc—switch Yfr—voltage source VscL.

At this time, the source voltage of the switch Ypn becomes the voltage VscL (which is a negative voltage), and the drain voltage thereof becomes 0V because the switch Ypn' is off. Accordingly, the source-drain voltage of the switch Ypn' becomes the voltage VscL, thereby enabling a withstand voltage of the switch Ypn' to be reduced by the voltage Vs (which is a positive voltage) as compared with the conventional one (e.g., Vs-VscL). Consequently, it is possible to use a switch with a low withstand voltage as the switch Ypn'.

On the other hand, in the reset driver 321 according to the first embodiment of the present invention, the switch Yer that generates the falling ramp waveform of the first step is connected in series with the switch Yrr that generates the rising ramp waveform. As a result, when the rising ramp waveform is applied to the panel capacitor Cp as the switch Yrr is turned on, the drain voltage of the switch Yer becomes a voltage Vset (i.e., Vset−Vs+Vs). Consequently, the drain-source voltage of the switch Yer becomes the voltage Vset because the source thereof is connected to the ground terminal GND.

Thus, in the reset driver 321 according to the first embodiment of the present invention, a switch with a low withstand voltage can be used as the switch Ypn', but a switch with a very high withstand voltage must be used as the switch Yer.

Figure 8:
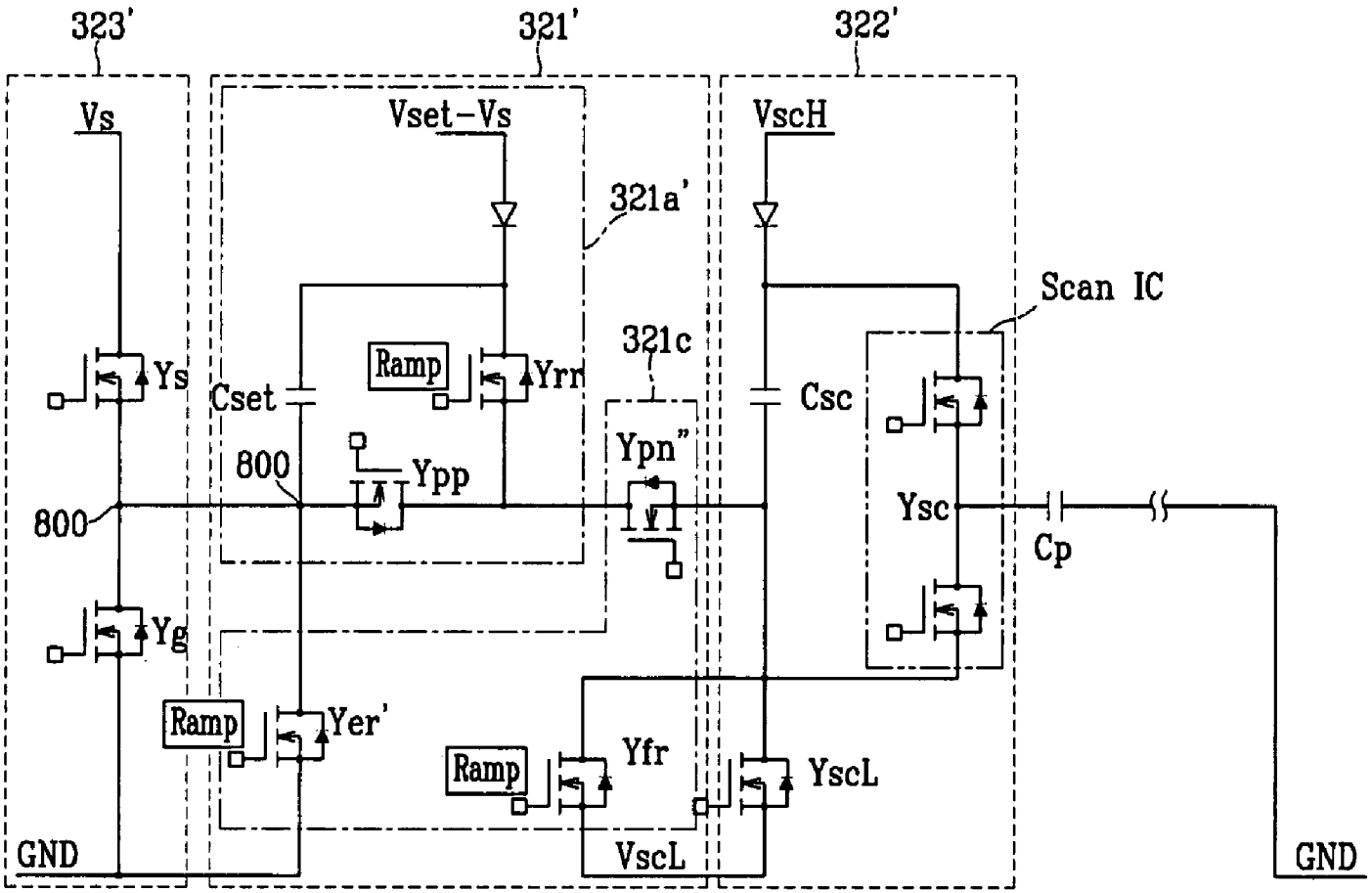
FIG. 8 is a detailed circuit diagram of a Y electrode driver of a PDP according to a second embodiment of the present invention.

Referring to FIG. 8, a second embodiment of the present invention provides a PDP driving apparatus including a falling ramp generator 321*c* which is capable of lowering both the withstand voltages of switches Ypn" and Yer'.

FIG. 8 is a detailed circuit diagram of a Y electrode driver (e.g., driver 320 of FIG. 5) including a reset driver 321', a scan driver 322' and a sustain driver 323'.

The reset driver 321' includes the falling ramp generator 321*c* for generating a falling reset waveform in a reset period and a rising ramp generator 321*a'* for generating a rising reset waveform in a reset period.

As shown in FIG. 8, the falling ramp generator 321*c* according to the second embodiment of the present invention includes a ramp switch Yer' connected between the constant-voltage capacitor Cset of the rising ramp generator 321*a'* and the ground terminal GND for generating a falling ramp waveform of the first step that falls from the voltage Vs to 0V, a ramp switch Yfr connected between the panel capacitor Cp and the voltage source VscL for generating a falling ramp waveform of the second step that falls from 0V to the voltage VscL, and a switch Ypn" formed on the main path for preventing a reverse flow of current.

A process of applying a falling reset pulse to the panel capacitor Cp by the Y electrode driver of FIG. 8 (e.g., the driver 320) including the falling ramp generator 321*c* according to the second embodiment of the present invention will hereinafter be described with reference to FIGS. 9A and 9B.

Figure 9A:
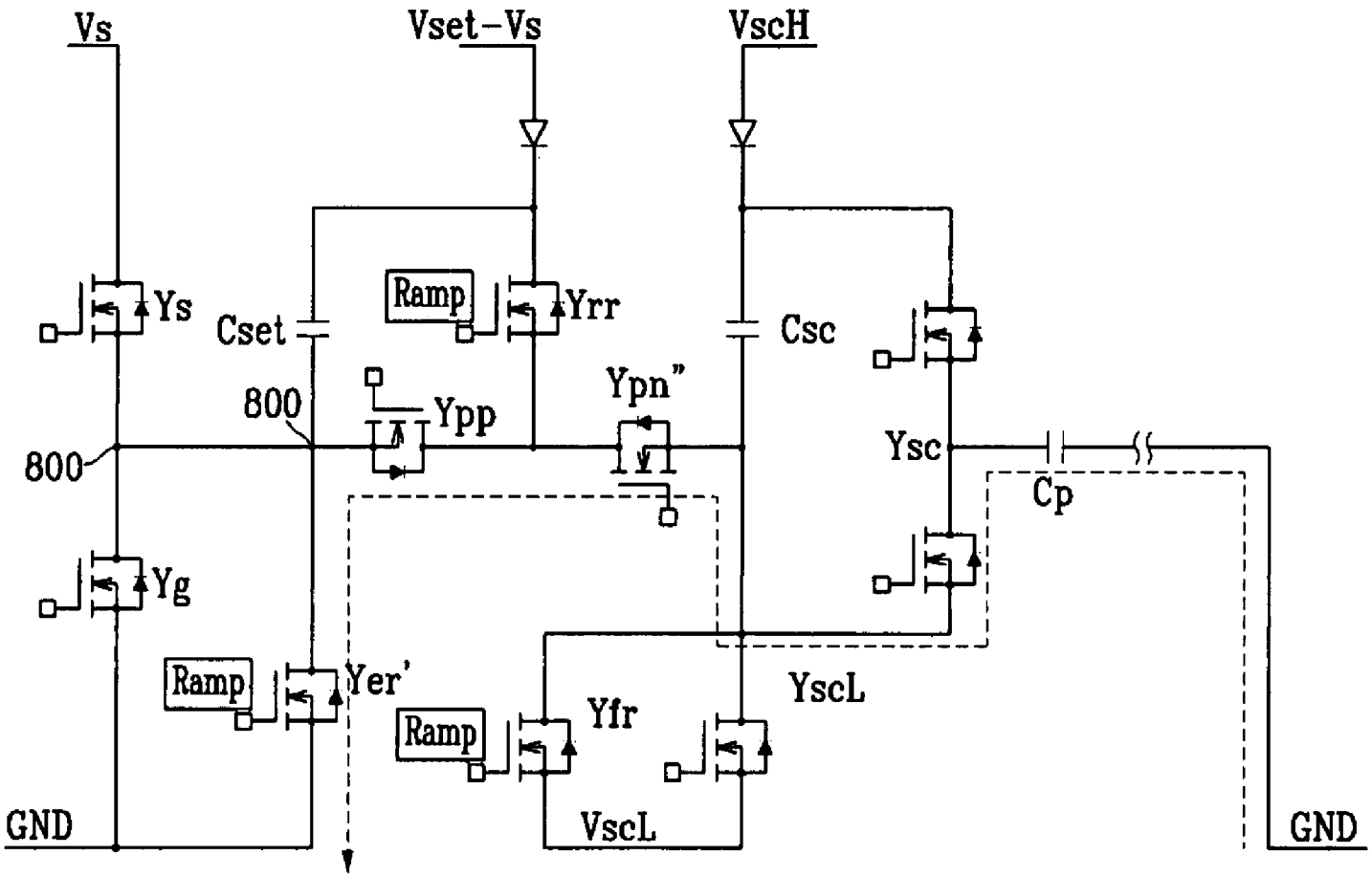
FIGS. 9A and 9B are circuit diagrams illustrating current paths when a falling reset waveform is applied to the Y electrode of the panel capacitor Cp in the reset period by the Y electrode driver according to the second embodiment of the present invention.
Figure 9B:
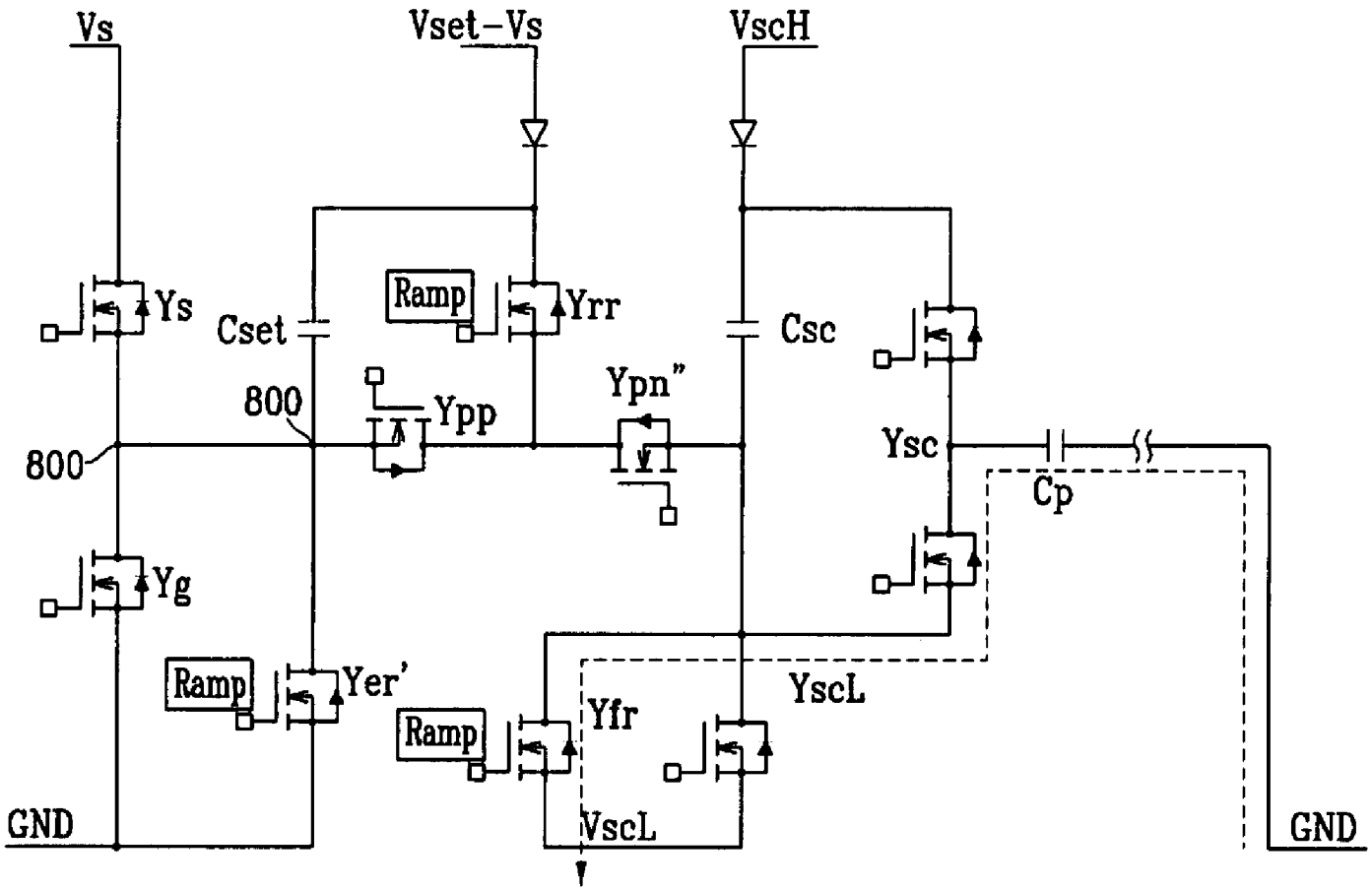

FIGS. 9A and 9B are circuit diagrams illustrating current paths when a falling reset waveform is applied to the Y electrode of the panel capacitor Cp in the reset period by the Y electrode driver of FIG. 8 (e.g., the driver 320) according to the second embodiment of the present invention.

Similarly to the first embodiment of the present invention, in the Y electrode driver according to the second embodiment of the present invention, before a falling reset waveform is applied to the Y electrode, the switches Ys and Ypn" are turned on and the switch Ypp is turned off, so that the voltage Vs is applied to the Y electrode. As a result, each of the source voltage and drain voltage of the switch Ypn" becomes the voltage Vs.

Thereafter, when the switch Ypn" is turned off and the switches Ypp and Yer' are turned on, a falling ramp waveform of the first step that is slowly reduced from the voltage Vs to 0V is applied to the panel capacitor Cp along a path (path of FIG. 9A) of panel capacitor Cp—switch Ysc—body diode of switch Ypn"—switch Ypp—switch Yer'—ground terminal GND. At this time, each of the source voltage and drain voltage of the switch Ypn becomes 0V, too.

Next, when the switches Ypp and Yer' are turned off and the switch Yfr is turned on under the condition that the switch Ypn" is in its off state, a falling ramp waveform of the second step that is slowly reduced from 0V to the voltage VscL is applied to the panel capacitor Cp along a path (path of FIG. 9B) of panel capacitor Cp—switch Ysc—switch Yfr—voltage source VscL.

At this time, the source voltage of the switch Ypn" becomes the voltage VscL, and the drain voltage thereof becomes 0V because the switch Ypn" is off. Accordingly, the source-drain withstand voltage of the switch Ypn" becomes the voltage VscL.

Figure 10:
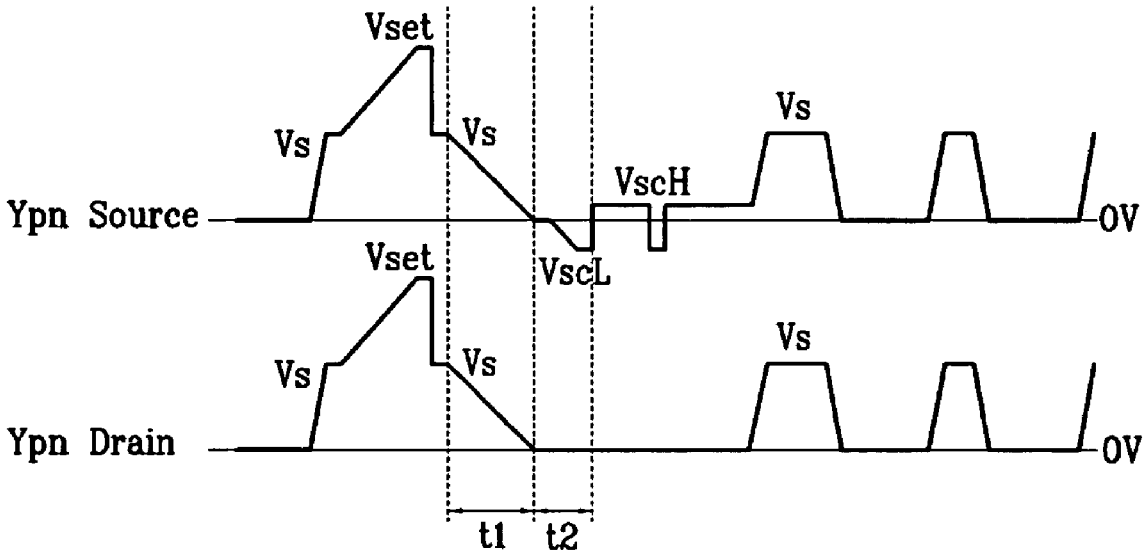
FIG. 10 is a waveform diagram of voltages applied to a first main terminal and second main terminal of a switch Ypn in a reset driver according to the first and second embodiments of the present invention.

FIG. 10 is a waveform diagram of voltages applied to the source and drain of the switch Ypn' and the switch Ypn" respectively in the reset driver 321 and the reset driver 321' according to the first and second embodiments of the present invention.

On the other hand, in the reset driver 321' of FIGS. 8, 9A and 9B according to the second embodiment of the present invention, the switch Yer' that generates the falling ramp waveform of the first step is connected to the connection point or points 800 of the capacitor Cset of the rising ramp generator 321*a*' and the switch Ys of the sustain driver 323'. As a result, the source-drain voltage of the switch Yer' becomes the voltage Vs (which is less than Vset).

Therefore, a switch with a lower withstand voltage than that of the switch Yer of the reset driver 321 of FIGS. 6, 7A, and 7B according to the first embodiment of the present invention can be used as the switch Yer' of the reset driver 321' of FIGS. 8, 9A, and 9B according to the second embodiment of the present invention.

As is apparent from the above description, according to the present invention, two ramp switches are used to apply a two-step falling ramp waveform to a Y electrode in a reset period, thereby making it possible to lower a withstand voltage of a switch which is formed on a main path to block the flow of current when the falling ramp waveform is applied.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An apparatus for driving a plasma display panel having first and second electrodes formed therein to apply a falling waveform to the first electrode, comprising:

a sustain driver for applying a sustain discharge voltage to the first electrode;

a first transistor having a first main terminal coupled to the sustain driver and a second main terminal coupled to the first electrode;

a second transistor having a first main terminal coupled to the first electrode and a second main terminal coupled to a first voltage source that supplies a first voltage level; and a third transistor having a first main terminal coupled between the sustain driver and the first main terminal of the first transistor and a second main terminal coupled to a second voltage source that supplies a second voltage level, wherein the second and third transistors allow a voltage at the first electrode to fall with a two-step falling ramp waveform from a third voltage level to the second voltage level and then from the second voltage level to the first voltage level.

2. The apparatus of claim 1, further comprising a fourth transistor having a first main terminal coupled to the first main terminal of the first transistor and a second main terminal coupled to the sustain driver.

3. The apparatus of claim 2, wherein the first main terminal of the third transistor is coupled to a connection point of the first transistor and the fourth transistor.

4. The apparatus of claim 3, wherein the first transistor includes a body diode, wherein the voltage at the first electrode falls from the third voltage level to the second voltage level along a path including the body diode of the first transistor and the third transistor, and wherein the voltage at the first electrode falls from the second voltage level to the first voltage level through the second transistor.

5. The apparatus of claim 4, wherein the first transistor includes a body diode, wherein the voltage at the first electrode falls from the third voltage level to the second voltage level along a path including the body diode of the first transistor, the fourth transistor and the third transistor, and wherein the voltage at the first electrode falls from the second voltage level to the first voltage level through the second transistor.

6. The apparatus of claim 4, wherein a voltage between the first main terminal and second main terminal of the first transistor is the same in level as the second voltage level when a waveform falling from the second voltage level to the first voltage level is applied to the first electrode.

7. The apparatus of claim 6, wherein the second voltage level is a zero voltage level.

8. The apparatus of claim 2, wherein the first main terminal of the third transistor is coupled to a connection point of the fourth transistor and the sustain driver.

9. The apparatus of claim 2, further comprising a fifth transistor coupled to a third voltage source that supplies a fourth voltage level, the fifth transistor being also coupled to the first transistor and the fourth transistor, the fifth transistor applying a rising waveform to the first electrode, wherein the fourth transistor is turned off when the fifth transistor is turned on.

10. The apparatus of claim 1, wherein the first voltage level is a negative voltage level.

11. The apparatus of claim 10, wherein the third voltage level is a positive voltage level.

12. The apparatus of claim 11, wherein the second voltage level is a ground voltage level.

13. The apparatus of claim 1, wherein the first voltage level is a VscL voltage level and the third voltage level is a Vs voltage level.

14. The apparatus of claim 1, wherein the first, second, and third transistors are n-channel transistors and wherein the first main terminals of the first, second, and third transistors are drains and the second main terminals of the first, second, and third transistors are sources.

15. A plasma display panel comprising:

a plasma panel having first and second electrodes formed therein; and a driver for applying a driving waveform to the plasma panel to drive it, wherein the driver includes:

a first transistor coupled between a first node and a first voltage source that supplies a first voltage level for sustain discharge to the first electrode in a sustain period;

a second transistor having a first main terminal coupled to a second node and a second main terminal coupled to the first node;

a third transistor having a first main terminal coupled to the second node and a second main terminal coupled to a third node;

a fourth transistor having a first main terminal coupled to the third node and a second main terminal coupled to a second voltage source that supplies a second voltage level, the fourth transistor being operated to slowly reduce a voltage at the first electrode; and a fifth transistor having a first main terminal coupled to the first node and a second main terminal coupled to a third voltage source that supplies a third voltage level lower than the second voltage level, the fifth transistor being operated to slowly reduce the voltage at the first electrode, wherein the first electrode is coupled to the third node.

16. The plasma display panel of claim 15, wherein the fourth transistor of the driver is turned on to reduce the voltage at the first electrode to a desired voltage level, and the fifth transistor of the driver is then turned on to reduce the voltage at the first electrode to the third voltage level.

17. The plasma display panel of claim 15, wherein the third, fourth, and fifth transistors are n-channel transistors and wherein the first main terminals of the third, fourth, and fifth transistors are drains and the second main terminals of the third, fourth, and fifth transistors are sources.

* * * * *